US007595470B1

(12) United States Patent
Sizer et al.

(10) Patent No.: US 7,595,470 B1
(45) Date of Patent: Sep. 29, 2009

(54) METHOD AND APPARATUS FOR HEATING AND ASEPTIC DISPENSING OF STERILE PRODUCT

(76) Inventors: Charles E. Sizer, 2408 Marshall Ct., Naperville, IL (US) 60565; Charles E. Sizer, IV, 2408 Marshall Ct., Naperville, IL (US) 60565

( * ) Notice: Subject to any disclaimer, the term of this patent is extended or adjusted under 35 U.S.C. 154(b) by 464 days.

(21) Appl. No.: 11/356,536

(22) Filed: Feb. 17, 2006

Related U.S. Application Data

(60) Provisional application No. 60/654,612, filed on Feb. 18, 2005.

(51) Int. Cl.
*H05B 6/80* (2006.01)
*H05B 6/64* (2006.01)

(52) U.S. Cl. ..... 219/689; 219/686

(58) Field of Classification Search ..... 219/689, 219/678, 679, 680, 681, 682, 683, 684, 685, 219/686, 687, 688
See application file for complete search history.

(56) References Cited

U.S. PATENT DOCUMENTS

| | | | | |
|---|---|---|---|---|
| 228,889 | A | | 6/1880 | Gue et al. |
| 1,393,045 | A | | 10/1921 | Scott |
| 2,497,721 | A | | 2/1950 | Foulkes |
| 3,964,175 | A | | 6/1976 | Sivetz |
| 4,146,153 | A | | 3/1979 | Bailen |
| 4,306,667 | A | | 12/1981 | Sedam et al. |
| 4,359,543 | A | | 11/1982 | Sedam et al. |
| 4,376,496 | A | | 3/1983 | Sedam et al. |
| 4,523,697 | A | | 6/1985 | Jeans |
| 4,564,127 | A | | 1/1986 | Garabedian et al. |
| RE32,179 | E | | 6/1986 | Sedam et al. |
| 4,618,500 | A | | 10/1986 | Forquer |
| 4,709,835 | A | | 12/1987 | Kruger et al. |
| 4,790,239 | A | | 12/1988 | Hewitt |
| 4,823,988 | A | | 4/1989 | Raque et al. |
| 4,863,036 | A | | 9/1989 | Heijenga |
| 4,901,886 | A | | 2/1990 | Kirschner |
| 4,921,138 | A | | 5/1990 | Quinn et al. |
| 4,983,408 | A | | 1/1991 | Colton |
| 5,180,896 | A | * | 1/1993 | Gibby et al. ..... 219/687 |
| 5,307,955 | A | | 5/1994 | Viegas |
| 5,368,195 | A | | 11/1994 | Pleet et al. |
| 5,514,123 | A | | 5/1996 | Adolf et al. |
| 5,615,801 | A | | 4/1997 | Schroeder et al. |
| 5,637,343 | A | | 6/1997 | Ryan |
| 5,644,972 | A | | 7/1997 | Dahmen et al. |
| 5,735,436 | A | | 4/1998 | Schroeder et al. |
| 5,740,945 | A | | 4/1998 | Shipway |
| 5,755,155 | A | | 5/1998 | Buesing |
| 5,759,486 | A | * | 6/1998 | Peterson ..... 422/21 |
| 5,803,312 | A | | 9/1998 | Credle |
| 5,884,457 | A | | 3/1999 | Ortiz et al. |

(Continued)

*Primary Examiner*—Daniel L Robinson
(74) *Attorney, Agent, or Firm*—Clause Eight IPS; Michael Catania

(57) ABSTRACT

A method and apparatus (20) for heating and dispensing a sterile product is disclosed herein. The apparatus (20) preferably includes a source of the sterile product (25), a flow containment means (30), a pumping means (35), a heating means (40) and a dispenser (45). Preferably, the sterile product is sterile milk which is pumped from an aseptic bag (25) through tubing (30) using a peristaltic pump (35). Then, the sterile milk is heated within tubing positioned within a microwave oven (40), and then flowed to a dispenser (45).

5 Claims, 7 Drawing Sheets

U.S. PATENT DOCUMENTS

| | | | |
|---|---|---|---|
| 6,024,252 | A | 2/2000 | Clyde |
| 6,406,730 | B1 | 6/2002 | Banyard et al. |
| 6,488,974 | B1 | 12/2002 | Kuehner et al. |
| 6,491,189 | B2 | 12/2002 | Friedman |
| 6,514,552 | B1 | 2/2003 | Sivetz |
| 6,602,538 | B1 | 8/2003 | Watkins, Jr. et al. |
| 6,756,069 | B2 | 6/2004 | Scoville et al. |
| 6,769,231 | B2 | 8/2004 | Danby |

* cited by examiner

METHOD AND APPARATUS FOR HEATING AND ASEPTIC DISPENSING OF STERILE PRODUCT

CROSS REFERENCES TO RELATED APPLICATION

This Application claims priority to U.S. Provisional Patent Application No. 60/654,612, which was filed on Feb. 18, 2005.

STATEMENT REGARDING FEDERALLY SPONSORED RESEARCH OR DEVELOPMENT

Not Applicable

BACKGROUND OF THE INVENTION

1. Field of the Invention

The present invention is related to heating and aseptic dispensing of a sterile product. More specifically, the present invention relates to heating and aseptic dispensing of a sterile milk product.

2. Description of the Related Art

The brewing of coffee using only coffee beans and water is an art practiced through the world. While many different coffee beans, roasting and grinding techniques, bean/water ratios may be used based on regional and cultural preferences, the basic hot extraction method remains similar. Therein, the bean in desired form is exposed at an elevated temperature for a period of time sufficient to extract the desired constituents for the taste of the end consumer. Against such background, it is widely accepted that excessive brewing temperature can adversely affect the palatability of the resulting brew. Similarly, insufficient brewing temperature results in insufficient extraction and an undesirably weak brew. Further, it is widely accepted that reheating a properly brewed coffee to excessive temperatures can also adversely affect the desired taste. Accordingly, notwithstanding advances in automatic equipment available to the consumer, brewing a highly palatable coffee remains an elusive challenge.

Recently, in addition to regularly brewed coffee, specialized coffee drinks have become popular. Mocha, espresso, cafe latte, cappuccino and the like require brewing techniques not readily and reliably practiced in the consumer setting, and accordingly are available primarily only at commercial settings having specialized equipment and personnel for such products. Also, cold coffees are becoming popular and require a non-bitter coffee concentrate that will maintain desired flavor in the presence of dilution with ice and additives.

Traditional dispensing of perishable foods like coffee milk rely on refrigeration to prevent the growth of harmful bacteria and delay spoilage. The cold temperature and cumbersome nature of having to pour the milk into a container to be heated result in a process that requires a significant amount of time for the preparation of a beverage like a latte.

Aseptic packing is a well-known technique used to prolong the shelf life of food or drink products. Fundamentally, the principle of the aseptic packing technique is based on filling and sealing the product in packages under sterile or bacteria-free conditions, in order to create the best possible circumstances for transportation and storage of the product e.g. without need for cold storage. For the shelf life to be as long as possible, both the product and the packing material are sterilized and the filling of the product in the package is under conditions avoiding re-contamination of the product.

The aseptic packing technique is e.g. used for packing of liquid food or drinks in pouches when a prolonged shelf life is desired. In a dispenser system, for convenient dispensing of the product, the pouch is provided with a port adapted for receiving a dispensing device such as an opening/closing mechanism or simply a dispensing tube.

In a dispensing system the attachment of a dispensing device to the port of a pouch is a suitable way to assist in emptying the liquid product from the pouch. However, upon attachment of a dispensing device to the pouch the integrity of the pouch is violated and there is a risk that bacteria on the dispensing device may contaminate the content of the pouch and the product passing through it. The risk of contamination is also increased if the product is sucked back into the pouch. This may not have a major influence if the pouch is to be emptied shortly after opening. Also if the product in the pouch is acidic, with for example a pH at 4.6 or below, the food product may be stable for a short time period after breach of the integrity of the package. Acidic food products include ketchup, mustard, concentrated fruit juice, and the like. However, if the pouch contains a non-acidified product, the life of the product may be considerably lowered due to contamination by connecting a foreign member to the pouch and product. An example of a non-acid food product is fluid milk or unfrozen ice cream mix.

Current aseptic pouches are filled aseptically, but for dispensing, a dispensing tube with fitment is attached to the pouch at the point of use, e.g. at a pre-fixed port on the pouch. Such an attachment may contaminate the product in the pouch. If the food product is a non-acid, the food product should be maintained under refrigeration to ensure the life of the food product.

Aseptic (or sanitary or sterile) packaging of milk, other foods, and other products requires that the food must be initially sterilized or otherwise treated, as by pasteurizing it. Then, throughout the packaging operation, the food must be kept sanitary. Care must be taken to ensure that the food is not contaminated with cleaning fluids, lubricants, ambient air, or unsterile matter. If the food is not aseptic (for example, properly-handled conventionally pasteurized milk is not aseptic), stringent steps must be taken to avoid trapping the food in any crevice, pocket, dead end or mechanism, as entrapped food which is not aseptic may sustain microbial growth and may form unsightly lumps or particles. The machinery should be designed to facilitate regular inspection of any mechanism which might deteriorate and thus trap the food or expose it to contaminants. As stopping such machinery for any extended time generally compromises the sanitary status of the food, each time a packaging machine is stopped for a substantial time, the packaging machine must be cleaned and sanitized before resuming production.

The industry has developed ways to maintain packaging machinery in a sanitized condition while minimizing the need to disassemble it for cleaning. For example, the United States government and the dairy industry have worked together to define standards for maintaining permanently installed piping in milk processing plants and the like in sanitary condition by cleaned-in-place (CIP) or mechanical cleaning. See 3A Accepted Practices For Permanently Installed Product And Solution Pipelines And Cleaning Systems Used In Milk And Milk Product Processing Plants, Number 605-04, DAIRY, FOOD AND ENVIRONMENTAL SANITATION, Vol. 12, No. 2 (February, 1992). In CIP cleaning, the milk distribution mechanism is cleaned and sanitized solely by circulating cleaning or sanitizing fluids (such as water, detergent solutions, acid or caustic solutions, other chemicals, or steam) through the piping as required. An apparatus meeting the 3A standard is very desirable, as it can be efficiently used, cleaned and kept sanitary, even though the pasteurized milk being processed is not aseptic and remains perishable.

Quinn et al., U.S. Pat. No. 4,921,138 for Device For Administration Of Enteral Fluids From Pre-Filled Shape Retentive Containers discloses an improved device for aseptic dispensing of enteral feeding solutions from shape retentive, pre-filled containers. The device includes a distensible hanger member formed around only the end panels of the container to suspend the container in an orientation to define only a single uppermost corner and a single lowermost corner. The device further includes corner attachment members for firmly securing a therapeutic fluid dispensing column only to the uppermost and lowermost corners of the container. The fluid dispensing column has venting and dispensing spikes, and the spikes have an outer configuration which forms leakproof seals with an aperture formed in the container. The spikes further include an arrangement of laterally opposed inlet ports joined to a large diameter axial bore.

Shipway, U.S. Pat. No. 5,740,945 for a Method And Apparatus For Sterile Dispensing Of Product discloses a method and apparatus for sterile dispensing of a product from an aseptic source. Shipway discloses a valve device adapted for mounting at the outlet of the source, mounting the valve device on the outlet, providing sterilizing medium, and sterilizing the outlet and valve with the medium prior to dispensing the product. Shipway discloses a sterilizing chamber between a valve member and the valve device for continuously sterilizing part of the valve member in the chamber while product delivery occurs to create an aseptic barrier between the product and the environment.

Bailen, U.S. Pat. No. 4,146,153 for a Sterile Dispensing Device discloses a sterile dispensing device in which sterile material in liquid or powdered form is supplied and from which the material can be transferred, as in a laboratory or hospital, to another sealed sterile container such as a bottle or flexible plastic bag. The device comprises a flexible plastic container for containing the material and having a sealed neck and a hollow cylindrical adapter mounted on the neck and having a hollow spike and hollow needle therewithin which are in communication with each other. Means, such as external threads on the container neck and engaged with internal threads in one end of the adapter, enable the adapter to be rotated and thereby moved from one position to another operative position wherein the spike pierces the container neck seal and enables the material to be transferred through the spike and the needle, as when the needle is inserted into the aforesaid other sealed container. The adapter, which is provided with a removable protective cover at one end and which has a built-in filter, is maintained in the aforesaid position prior to use by means of a removable sealing member which secures it to the container.

Ortiz, et al., U.S. Pat. No. 5,884,457 for a Method And Apparatus For Automatically Producing A Plurality Of Sterile Liquid Filled Delivery Devices discloses a method of automatically producing a plurality of prefilled, sterile delivery devices with a desired quantity of fluid. The sterile delivery devices each include a hollow barrel with a dispensing nozzle at one end and an open opposite end. A piston plunger is positioned within the open end and is slidable in sealing engagement with the barrel to retain a fluid therein. A tip is secured to the dispensing nozzle. A plurality of the sterile delivery devices are automatically fed along a predetermined path. Tips are then removed from the dispensing nozzles of the sterile delivery devices. The hollow barrels of the sterile delivery devices are then filled through the dispensing nozzles with a desired quantity of fluid. The dispensing nozzles of the sterile delivery devices are then closed and sealed after the filling step to provide sealed sterile delivery devices with sterile fluid contents.

Adolf, et al., U.S. Pat. No. 5,514,123, for a Sterile Formed, Filled And Sealed Flexible Container discloses a sterile form, filled and sealed flexible solution container and an attached port assembly that allows for the sterile dispensing of the solution. In particular, Adolf discloses a sterile formed, filled and sealed flexible solution container and a sterile administration port assembly which is attached without interrupting the complete sealing of the hermetically sealed fluid container and which allows for the sterile packaging, storage and delivery of a sterile medical solution without heat degradation or oxygen permeation.

Danby, U.S. Pat. No. 6,769,231, for an Apparatus, Method And Flexible Bag For Use In Manufacturing discloses a method for manufacturing in which a fluent material is dispensed to an article such as a container from a flexible bag. The fluent material is dispensed directly to the container without any intervening structure which contacts the fluent material. Accordingly, the apparatus can be constructed of less expensive materials and does not require frequent cleaning. The apparatus acts on the bag to dispense and does not act on the fluent material. The apparatus has particular application where aseptic conditions need to be maintained such as in the packaging of food and medicine. The flexible bag is preferably formed with multiple outlets permitting simultaneous dispensing to multiple containers.

Clyde, U.S. Pat. No. 6,024,252 for a Dispenser System discloses a dispenser system for dispensing a liquid food or drink product from a flexible pouch, wherein the system includes a housing configured and adapted for receiving a flexible pouch adapted to contain a liquid food or drink product. The pouch has a built-in dispensing tube with an inlet and an openable outlet, and a valve system adapted for engaging with the dispensing system externally between its inlet and its outlet so as to control the dispensing of liquid food or drink product from the pouch upon opening of the tube outlet. Clyde further discloses a method for dispensing a liquid food or drink product using the dispenser system and a flexible pouch for use in the system, wherein the pouch contains an aseptically filled liquid food or drink product and has a built-in dispensing tube with an inlet and an openable outlet, and the pouch and the dispensing tube are sterilized prior to filling.

Raque, et al., U.S. Pat. No. 4,823,988 for an Aseptic Filling Arrangement discloses an aseptic food handling system for filling containers with presterilized food which includes a first cylinder, having an inlet and an outlet, where food products to be packaged are received in the inlet and where the cylinder contains a piston operable from first position to receive product through the inlet to a second position to emit the food product from the outlet wherein the cylinder includes sterilizing fluid passageway to selectively admit sterilizing fluid to the cylinder to expose the internal surfaces of the cylinder and the piston to the sterilizing fluid and can be operated by an adjustable two position motive cylinder. A second dispensing cylinder can also be provided to receive the food product from the first cylinder and direct it to a food container.

Buesing, U.S. Pat. No. 5,755,155, for an Aseptic Process Interface Group discloses an interface between an aseptic or pasteurized product supply vessel, one or more product dispensing machines, and a cleaning liquid supply vessel. The interface can be used for directing milk and other foods from a process line to a packaging or other machine. In one variation, the interface has first and second spaced liquid supply valves, arranged in series, between the cleaning liquid inlet and the product dispensing machine outlet. The piping between the two valves can be drained, and optionally filled with steam or other sterilizing fluid, to provide a barrier between the cleaning fluid upstream of one valve and the food located downstream of the other valve which is en route to the packaging machine. In another variation, the interface has a product supply valve, a drain isolation valve, a drain between those two valves and itself controlled by a drain valve, and a cleaning liquid supply valve. The interface is versatile, and can be used for meeting the 3A standard for pasteurized dairy products, as well as the different standards for aseptic and near-aseptic packaging.

Kuehner, et al. U.S. Pat. No. 6,488,974 for a Package Containing A Milk Product Or Milk Substitute Product discloses a package for dispensing a foamed milk product. This package includes an aerosol can which contains a liquid phase in which a propellant gas is dissolved. The can is provided with a valve and a nozzle immediately downstream of the valve for spraying and foaming of the liquid phase. The nozzle has a central borehole and at least one lateral orifice which opens into an outlet tube. As the liquid phase is dispensed through the nozzle, a foam is generated.

Friedman, U.S. Pat. No. 6,491,189 for a Dispensing Valve For Fluids discloses a dispensing valve which requires only a minimal force exerted on the valve actuator to maintain the valve in an open position. A resilient valve actuator having the characteristics of a nonlinear spring is provided at an actuator end of the valve body and operatively connected to a plunger, with the opposite end of the plunger mounting a resilient valve seal which serves to open and close a plurality of port openings. The valve is configured so as to allow it to be sterilized through high levels of radiation and through high temperature steam and chemical sterilization processes without degrading the valve structure or operation.

Scoville, et al., U.S. Pat. No. 6,756,069 for a System And Method For Dispensing A Liquid Beverage Concentrate discloses a device and method for dispensing dual component liquids or concentrates packaged in separate containers to provide protection from effects such as oxidation and moisture loss. The liquids or concentrates can be dispensed through a pumping system, preferably including a peristaltic pump, mixed together, and optionally diluted with another liquid, such as water, to provide a consumable beverage. In addition, the device can dispense liquids or concentrates having different viscosities, such that they are mixed together in the proper ratio.

Jeans, U.S. Pat. No. 4,523,697, discloses a container for dispensing a concentrate at a predetermined flow rate. The container also includes two mating assemblies, mating at an outlet valve, and a tube in its interior to permit controlled pressurization to the volume in the container.

Kruger et al. U.S. Pat. No. 4,709,835, discloses a disposable pouch for beverage syrups and concentrates including a collapsible bag, a discharge spout, and an insert that can be broken off when a dosing valve assembly is attached. The pouch has utility in a postmix beverage dispenser.

Viegas, U.S. Pat. No. 5,307,955, discloses a flaccid-bottom, lightweight delivery package for dispensing fluid products. The package contains a self-sealing dispensing valve and is particularly useful for storing and dispensing viscous fluid materials.

Beverages made from individual components are generally mixed together and dispensed by a dispensing system. Dispensing systems may be manual or automatic and may operate continuously or in discrete dispensation steps. Liquid dispensation systems typically involve at least a liquid receptacle for holding the liquid and a pump for dispensing the liquid into a consumable portion. A variety of liquid dispensing systems are commercially available and disclosed in the prior art. U.S. Pat. Nos. 4,306,667; 4,359,432; and 4376496, as well as U.S. Reissue Pat. No. RE 32179 all to Sedam et al., disclose a post-mix carbonated beverage dispensing system for used in refrigerated cabinets. The dispensing system contains a carbonator with a refillable water reservoir, a $CO_2$ system, a valving system, and a disposable package for containing and dispensing the post-mix beverage syrup.

Garabedian, U.S. Pat. No. 4,564,127, discloses a liquid dispenser system containing a collapsible bag with a self-sealing valve and clips to engage the dispenser, clip-receiving structures to engage the bag clips and open or close the valve, a pump, support for the bag, and a frame.

Kirschner, U.S. Pat. No. 4,901,886, discloses a post-mix juice dispensing system including a bag-in-tank system for reconstituting and dispensing a juice concentrate at freezer temperatures. The bag-in-tank system includes a pressurizable canister with a slidable carrier capable of forcing concentrate out of a flexible bag under pressure and placed therein.

Pleet, U.S. Pat. No. 5,368,195, discloses a pressurized bag-in-bottle fluid dispenser system for accurately delivering a viscous or semi-viscous liquid. The dispenser system is particularly suited for dispensing condiments, paints, pigments, or adhesives and includes a metering unit activated by a manually operated trigger on a gun.

U.S. Pat. Nos. 5,615,801 and 5,735,436 to Schroeder et al., disclose a disposable and recyclable juice concentrate package for a post-mix juice dispenser. The dispenser includes a pump that provides a continuous stream of concentrate, a package housing containing a container housing and a pump housing, and an integral mixing nozzle. The patent suggests that the continuous streaming of the concentrate into the mixing chamber of the dispenser improves mixing.

Credle, U.S. Pat. No. 5,803,312, discloses a manually operated, postmix juice dispenser. This low cost dispenser is used with a disposable concentrate package and includes a water tank, a water pump, and a pump handle. The disposable concentrate package for use with this system is generally a flexible pouch with a built-in concentrate pump that connects to the handle.

Heijenga, U.S. Pat. No. 4,863,036 for a Container For A Small Quantity Of Milk, Cream Or The Like discloses a container for a small quantity of milk, cream or the like, comprising a tub-shaped filling cavity with a flat circumferential stiff rim and a cover sheet thereto by means of a sealing seam, said flat rim and cover sheet at one side being extended beyond the connecting seam, for forming a pulling tab allowing said sheet to be pulled away for forming a dispensing opening. In the extended rim portion of the stiff rim, a channel communicating with the filling cavity is formed, extending slightly beyond the connecting seam and transversely to the outer boundary of said seam. Said channel, beyond the connecting seam, is surrounded by an additional sealing seam which is weaker than the connecting seam portion extending transversely to said channel, so that said pulling tab can be pulled away up to said connecting seam, for uncovering a dispensing opening with a fixed small dimension of said channel.

Banyard, et al., U.S. Pat. No. 6,406,730 for a Process For Producing Low Acid Food Products discloses a method and apparatus for treating a low acid food product. The low acid food product is first acidified to produce an acidified food product and then packaged as the acidified food product. The acidifying step comprises addition of a GRAS acid to adjust the pH to below about 4.5. The acidified food product is then deacidified to return the acidified food product to the low acid food product having a pH above 4.6. The deacidification is accomplished through the addition of an alkaline substance in an amount sufficient to deacidify the acidified food product to a pH of from about 5.8 to about 7.5.

Watkins, Jr. et al., U.S. Pat. No. 6,602,538 for a Coffee Concentrate discloses a coffee concentrate shelf stable for extended periods at ambient temperatures includes an aseptically packaged coffee concentrate of coffee and water obtained through a cold extraction process and processed under ultra high temperature and time conditions having value in the range of about 1 to 12.

Gue et al., U.S. Pat. No. 228,889 discloses separate cold and hot extracts obtained for appropriate dilution at time of use with additives incorporated to avoid the loss of desirable coffee qualities.

Colton, U.S. Pat. No. 4,983,408, discloses obtaining an extract by contacting an aqueous mixture of coffee with pressurized steam followed by enzyme treatment to produce a concentrate that may be reconstituted or converted to a soluble solid.

Scott, U.S. Pat. No. 1,393,045 discloses a heat exchange evaporation to produce a coffee concentrate without any process provisions for attaining ambient shelf life.

Sivetz, U.S. Pat. No. 3,860,940 discloses a process of hot water injection into a column containing coffee thereby producing a concentrated coffee vapor phase that is liquefied and packaged. No process provisions are incorporated for eliminating enzyme or bacterial degradation in the concentrate.

Foulkes, U.S. Pat. No. 2,497,721, discloses a high temperature extraction to which sodium phosphate and propylene glycol are added as stabilizers. Flash pasteurization or post packaging high temperature sterilization are employed to increase shelf life.

Forquer, U.S. Pat. No. 4,618,500 discloses a method for producing espresso-type coffee using low temperature and pressure brewing to form a concentrate followed by low temperature cooling for producing a product suitable for storage under refrigerated conditions.

Ryan, U.S. Pat. No. 5,637,343 discloses an ambient temperature extraction for forming a concentrated followed by microfiltration for removing bacteria from the process water and concentrate for enabling non-refrigerated storage. No post extraction procedures are employed for removing non-filterable pathogenic material.

Dahmen, et al., U.S. Pat. No. 5,644,972 for a System And Method For Brewing And Dispensing A Hot Beverage discloses a system for brewing and dispensing high quality beverages at remote locations comprising a high volume urn, a high volume transfer system, an insulated mobile canister, a dispensing system having a compressor, tank and hose assembly, and a dispensing tap. Coffee, or other brewed beverage, is brewed in the high volume urn. Once a complete batch of coffee has been brewed, the entire batch is transferred via gravity to a clean and empty mobile canister. Once full, the mobile canister can be moved to a remote dispensing location or stored for future use. When the mobile canister is moved to the dispensing location it is connected to the dispensing system which uses an air compressor to pressurize the beverage within mobile canister. The dispensing system also connects the canister to the dispensing tap, via a short, removable dispensing hose. The dispensing hose is wrapped with an electrical heater to maintain the beverage at the optimum serving temperature at the dispensing tap while keeping it below the temperature at which degradation occurs. When the dispensing tap is opened, the beverage is dispensed.

Hewitt, U.S. Pat. No. 4,790,239, for a System For Brewing And Serving A Hot Beverage discloses a method and system for brewing one or more hot beverages, such as gourmet coffees. The gourmet coffee is brewed, at a brewing temperature, in the liners of a brewing urn. After brewing, the coffee can be transferred to any one of three storage tanks by means of manual or solenoid valves, and, if desired, a gravity-assist pump. The shelf-life of the brewed coffee is increased substantially when stored at a serving temperature which is lower than the brewing temperature. Coffee contained in feed lines leading from each of the storage tanks passes through a pressurizing line to a tap tower located to provide efficient service to the coffee-purchasing customers. Hot water from the water jacket of the brewing urn is circulated in hot water lines retained in close proximity to the feed lines between storage tanks and the tap tower, thereby keeping the coffee in the feed lines at a desirable serving temperature. A control panel connected to level sensors in each of the storage tanks provides visible and audible indications to the operator that the supply of coffee in a particular storage tank is running out, so that the operator can brew a new batch of coffee. When the empty volume in a particular storage tank is adequate to store an additional full batch of freshly brewed coffee, the operator receives a second visible indication from the control panel. The operator can control pumps and valves from the control panel and can read the temperature of the coffee in each of the storage tanks.

The model food code requires that opened foods be protected from bacterial growth by maintenance of an environment hostile to bacteria.

The Code of Federal Regulations ("CFR") governs many, if not most, aspects of food processing. Specifically, the CFR sets forth distinctions between "low-acid" foods and so called "acidified" foods. According to 21 CFR Section 114.3, the phrase "low-acid foods" means any foods, other than alcoholic beverages, with a finished equilibrium pH greater than 4.6 and a "water activity" greater than 0.85. Low acid foods include milk, ice cream, creamers, and milk and/or vegetable fat containing beverages such as flavored cappuccino beverages. Special processing, packaging and handling of these products is necessary to prevent premature spoilage and the growth of microorganisms of public health significance. Current processing standards for unrefrigerated low acid foods require the application of a "minimum thermal process" with the application of heat to food, either before or after sealing in a hermetically sealed container, for a period of time and at a temperature scientifically determined to be adequate to ensure destruction of microorganisms of public health significance.

The phrase "acidified foods" means low-acid foods to which acid(s) or acid food(s) are added and which have a water activity greater than 0.85 and have a finished equilibrium pH of 4.6 or below. These foods include cucumbers, cabbage, artichokes, etc. These foods may be called "pickled." Acidity and salt levels are important factors retarding the growth and survival of bacteria and other microorganisms in acidified foods. Acidified food may be thermally processed, or processed with permitted preservatives to destroy vegetative cells of microorganisms of public health significance and to inhibit the reproduction of microorganisms of non-health significance.

Permitted chemical preservatives, pH and the water activity management of food products are important factors in extending food preservation beyond simple "pickling." It is well known in the art that the combination of permitted preservatives, pH and water activity management of a food product can essentially prevent microbial growth. Water activity is defined as a measure of the free moisture in a product and is the quotient of the water vapor pressure of the substance divided by the vapor pressure of pure water at the same temperature. Water activity management is a beneficial preservation technique in cases when a bacterial cell comes in contact with a food product of relatively low water activity, such that the bacterial cell dehydrates, thereby inhibiting bacterial growth. Such dehydration of the bacterial cell occurs as a result of osmotic dehydration, during which time water transfer occurs between the food substance and the bacterial cell until equilibrium is reached, i.e., until both the food substance and the bacterial cell have the same water activity. It is important to note that water activity is not proportional to moisture content of a substance. In fact, it is water activity and not moisture content that influences microbial growth. The challenge of food product design and formulation is to achieve relatively low water activity so that when the product comes in contact with bacterial cells, the level at which equilibrium is reached is low enough to inhibit almost all kinds of microbial growth. Therefore, it is essential in food chemistry to measure and monitor the water activity of a food substance as an aid in preventing spoilage.

Low acid food products require special processing, packaging and handling procedures (for example, aseptic processing and packaging; retort processing; or thermal processing with subsequent refrigeration), which add significantly to the cost of producing, distributing, and dispensing such low-acid food products. Acidified foods avoid much of these processing requirements and are, therefore, more economical to produce and store. Currently, a range of products such as non dairy creamers, frozen and iced cappuccino products, etc. are produced and are commercially viable only as low-acid foods. Low-acid versions (which are processed and packaged aseptically or are stored under refrigeration) are preferred by the market because of taste, texture and overall quality considerations. Acidified versions of these types of products suffer from poor taste and a lack of characteristic "dairy flavor notes" and creaminess that comes with fat, protein and other non-dairy solids.

Thus, efforts to develop high quality and shelf stable liquid concentrates that have "low acid flavor profiles" when reconstituted are a major objective of food and beverage companies, especially those who do not have aseptic processing capabilities.

BRIEF SUMMARY OF THE INVENTION

The invention is a preferably process to aseptically dispense commercially sterile foods from an aseptic bag into a heating means where the food is brought to a temperature close to boiling. The heated food product is then transferred into a consumer container while maintaining the asepticity of the sterile bag.

In a preferred embodiment, the invention aseptically dispenses milk (or other foods to be heated) from an aseptic bag using a presterilized hose or tubing. The tubing is preferably fed through a peristaltic pump and then introduced into a microwave cavity. The product is heated from ambient to the desired temperature using conventional microwave absorption heating and then exits the microwave to the dispensing port. The dispensing port is preferably maintained at a temperature greater than 140° F. (60° C.) to prevent microbiological growth where the product transitions from the aseptic environment into the septic environment. The dispensing port is preferably over-pressured with sterile air to prevent airborne contamination of the dispensing port and aseptic tubing.

In a most preferred embodiment, a 2.5 gallons aseptic bag containing commercially sterile milk would be manufactured using a sterile ⅜" soft, plastic hose which was sealed at the outlet. The hose would be inserted into a peristaltic pump and fed into a microwave cavity to be heated. The hose would exit the microwave cavity and the outlet fed through the dispensing port. The sequence of steps for heating the milk would determine the characteristics of the dispensed liquid allowing the operator some flexibility as to the amount dispensed and the temperature ranging from ambient to boiling.

The present invention preferably maintains a hostile environment at the point of dispensing using a temperature in excess of 140° F. (60° C.). Overpressure of sterile air also prevents contamination of the product thus maintaining the aseptic environment of the dispenser.

One aspect of the present invention is an apparatus for heating and aseptic dispensing of a sterile product. The apparatus includes a source of a sterile product, a pump, a heating means, a dispenser and a flow containment means connected between the source and the pump, the pump and heating means, and the heating means and the dispenser.

Another more specific apparatus includes an aseptic bag of sterile milk, a peristaltic pump, a microwave oven, and a tubing connected between the aseptic bag and the peristaltic pump, the peristaltic pump and the microwave oven, and the microwave oven and the dispenser.

The dispenser of the apparatus preferably has a source of sterile air maintained at a higher pressure to prevent contamination. A portion of the tubing of the apparatus is preferably positioned within a cavity of the microwave oven.

The apparatus also preferably includes an ultraviolet light and a source of air for providing the source of sterile air, with the sterile air flowing around the dispenser.

The apparatus also alternatively further includes a heating block to generate a temperature greater than 75° C. about an outlet of the dispenser.

The apparatus also alternatively includes a steam generator to generate a temperature greater than 75° C. about an outlet of the dispenser.

Another aspect of the present invention is a method for heating and aseptic dispensing of sterile milk. The method begins with providing an aseptic bag of sterile milk. Next, the sterile milk is pumped from the bag through tubing using a peristaltic pump. Next, the sterile milk is pumped into a portion of the tubing positioned with a cavity of a microwave oven. Next, the sterile milk is heated within the microwave cavity to a boiling point or near boiling point. Next, the heated sterile milk is flowed to a dispenser.

Preferably in practicing the method, the sterile milk is pumped at 600 ml/min. Preferably in practicing the method, 200 milliliters of sterile milk are heated within the microwave cavity.

Yet another aspect of the present invention is a method for heating and aseptic dispensing of sterile product. The method begins with providing a source of sterile product. Next, the product is pumped from the source through a flow containment means. Next, the sterile product is pumped into a portion of the flow containment means positioned with a heating means. Next, the sterile product is heated within the heating means. Next, the heated sterile product is flowed to a dispenser.

Preferably in practicing the method, the sterile product is heated to a boiling point or near boiling point of the sterile product. Preferably in practicing the method, the sterile product is pumped at 600 ml/min. Preferably in practicing the method, 200 milliliters of sterile product are heated within the heating means.

The method preferably further includes flowing overpressure sterile air about the dispenser to prevent contamination of the sterile product, and heating the dispenser or an area about the dispenser.

Preferably in practicing the method, the sterility of the contents is always maintained. Preferably in practicing the method, the heating means is a microwave.

The method preferably further includes generating heated water vapor in the microwave to propel sterile product from a cavity of the microwave into a dispenser.

Preferably in practicing the method, the sterile product is milk, and the method is utilized to efficiently heat or foam the milk for use in a cafe latte. Alternatively in practicing the method, the sterile product is aseptic milk and a source of the aseptic milk is stored at ambient temperature and the aseptic milk is dispensed at ambient temperature while maintaining asepticity.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
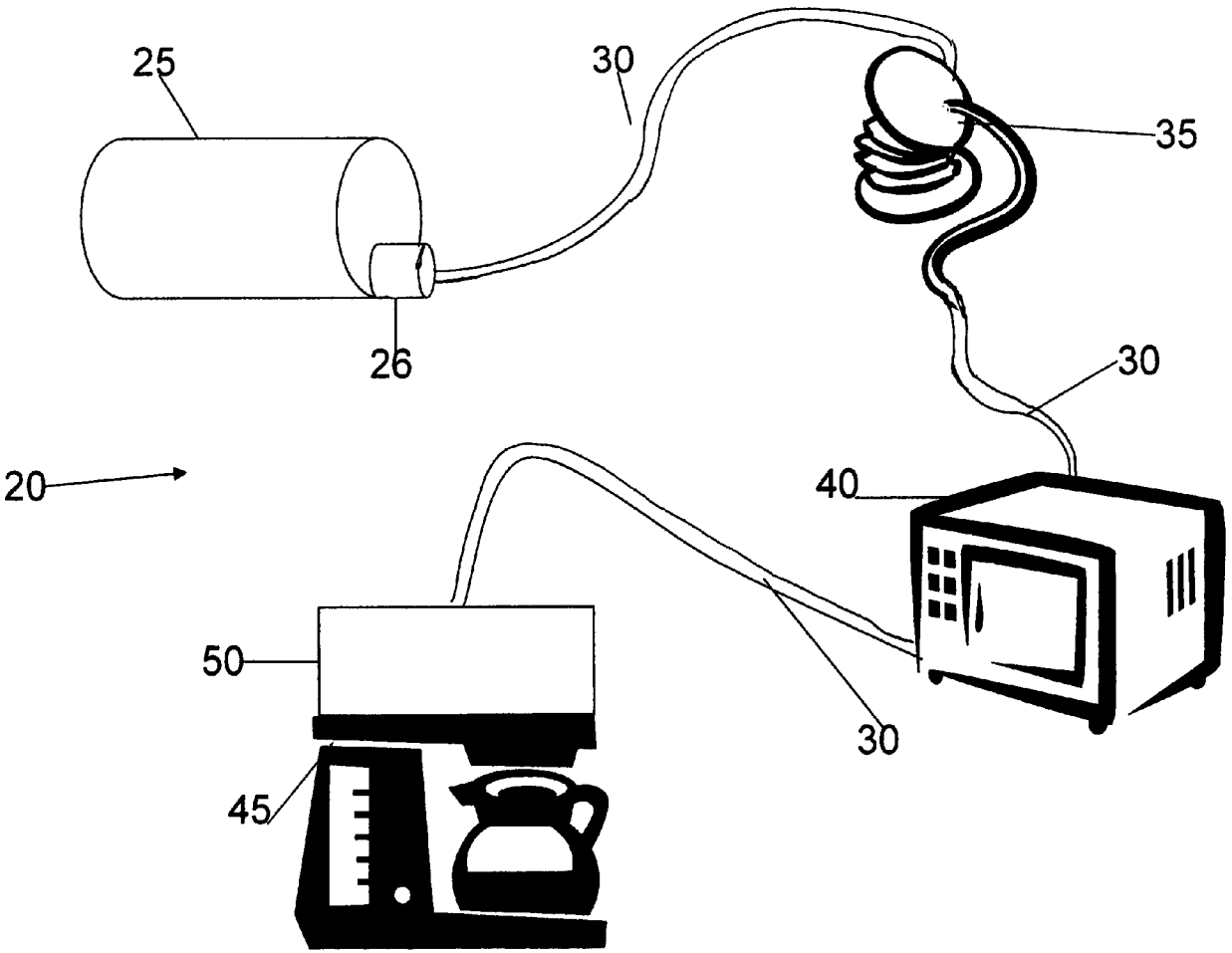
FIG. 1 is a schematic diagram of a preferred apparatus of the present invention.

As shown in FIG. 1, an apparatus or system of the invention is generally designated 20. The apparatus 20 preferably includes a source of a sterile beverage 25, a flow containment means 30, a pumping means 35, a heating means 40 and a dispensing means 45. In a preferred embodiment, the source of a sterile beverage 25 is preferably an aseptic bag filled with a sterile milk. The flow containment means 30 is preferably a plastic tubing. The pumping means 35 is preferably a peristaltic pump. The heating means 40 is preferably a microwave oven and the dispensing means 45 is preferably a milk dispenser, preferably for introduction into a coffee beverage.

Figure 2:
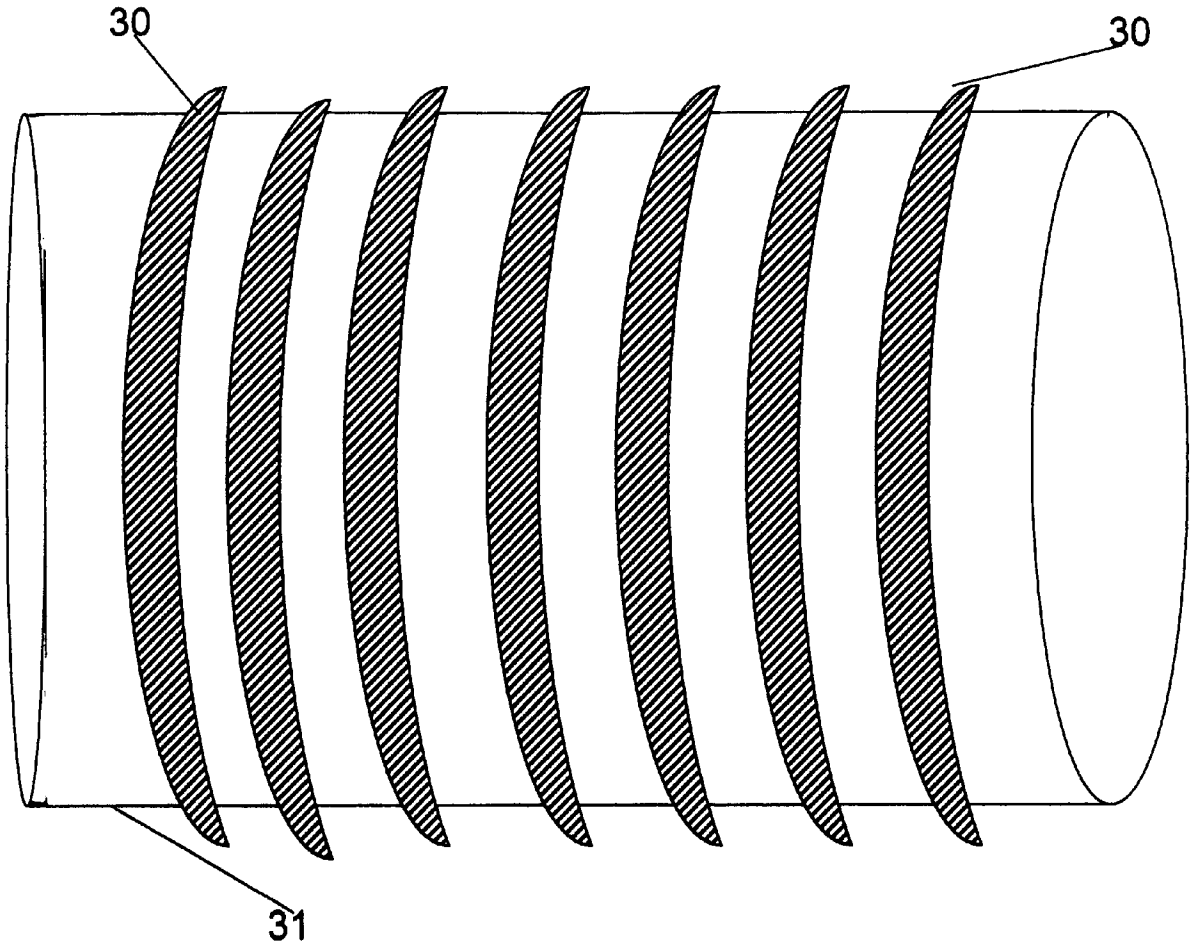
FIG. 2 is an isolated view of tubing utilized with the present invention.

The tubing 30 is connected to the bag 25 through a sealed outlet 26. The tubing 30 is positioned through the peristaltic pump 35 and into the cavity of the microwave oven 40. The tubing 30 is preferably coiled within the microwave oven 40 around a coiling structure 31, as shown in FIG. 2. The tubing 30 continues out of the microwave oven 40 to a dispenser 45. A source of sterile air 50 prevents contamination as explained below.

The tubing 30 when inserted into the apparatus 20 is sterile, however, the tubing 30 can become contaminated if handled improperly. One method to control surface contamination of the tubing 30 is to spray or wipe disinfectant on the tubing 30. An alternative method to sterilize the tubing 30 is to use a transparent clamping device to hold the tubing in an ultraviolet light to sterilize the surface using ultraviolet light, or even ultraviolet light and a sterilant like peroxide.

The bag 25 is preferably made of a flexible material (which as used herein would include a limp material), which can be formed in a sterile environment or formed and filled in a non-sterile environment and then subject to a sterilizing process. However, the bag 25 could also be used for products not requiring aseptic conditions. Any suitable material could be used to form the bag 25, such as an appropriate polymer, including without limitation polyvinyl chloride, polyolefin, polymer laminates and polymer alloys. The bag 25 is preferably transparent so that the flowable product contained within the bag can be readily seen to determine if the bag is empty. However, other ways of establishing whether the bag 25 is nearing empty can be employed.

To open the bag 25, the sealed outlet 26 should be aseptically cut to prevent contamination. The cutting of the sealed outlet 26 is preferably accomplished with a hot wire which is heat sterilized prior to initializing the cut of the sealed outlet 26. The hot wire (filament), or alternatively a hot blade (flat heated resistance surface) should preferably be heated to about 200-300° C. for about 1 to 1000 seconds, and then passed through the sealed outlet to sterilize the surface and open the bag.

Pure concentrated milk is taken to mean either a fresh milk which has been subjected to an evaporation in order to reduce the water content, or a recombined milk in which the dry matter content can be set. Recombined milk is envisaged to be milk from both skimmed milk powder and whole milk powder. This pure concentrated milk can optionally include sugars, sweeteners or flavorings. The content of these additives typically varies from about 0.1 to at most 5%. The sweeteners may also be sugar substitutes, such as saccharin or cyclamate. The flavoring is typically present in an amount of about 0.05 to less than 1%. Chocolate, cocoa, coffee, aroma substances, fruit (e.g., strawberry) extract, vanilla and spices can be used depending upon the desired flavor of the product. The evaporated milk is similar to pure concentrated milk, except that this milk additionally comprises a stabilizer, such as disodium hydrogenphosphate. This evaporated milk can likewise comprise sugars, sweeteners or flavorings.

A partial milk substitute product is taken to mean a milk in which the fat content consists of a milk fat portion and vegetable fat portion with the non-fat solids including milk, whey protein concentrate and foam stabilizers. This partial milk substitute product can also comprise sugars, sweeteners and/or flavorings. The preferred foam stabilizers include gelatin, carrageenan, guar seed flour, carob bean meal, a mono- or diglyceride or mixtures thereof. The vegetable fat is preferably selected from the group consisting of coconut fat, palm oil, soya oil, corn oil.

A total milk substitute product is taken to mean a product having a fat portion of a vegetable fat and a non-fat solids content of a carbohydrate, caseinate and foam stabilizer. The carbohydrates are preferably selected from the group consisting of maltodextrin and glucose syrup. The vegetable fat and the foam stabilizers can be the same as those already mentioned above.

Exemplary commercial pumps for use with the invention include, but are not limited to, MITYFLEX peristaltic pumps, available from Anko Products, Inc., of Bradenton, Fla., and peristaltic or dispensing pumps commercially available from Watson-Marlow of Cheltenham, England. In a preferred embodiment, the volumetric flow rate of the pump 35 is from about 100 mL/min to 2000 mL/min, more preferably from about 250 mL/min to 1000 mL/min, more preferably about 500 mL/min to 700 mL/min.

Peristaltic pumps typically operate using positive displacement. The fluid is forced through tubing by a number of rollers, which rotate squeezing a flexible tube against the pump housing. As the roller moves over and past a point on the tubing it expands to allow more fluid to enter. During operation there is at least one of the rollers in contact with the tubing at all time which therefore eliminates the need for valves to prevent backflow. The rollers or roller carriers are turned in the housing either directly by the motor or by a small gearbox which can alter the number of revolutions per minute. If the pump is direct driven increasing or decreasing the motor speed can control the flow. Peristaltic pumps are ideal for use with corrosive and viscous fluids as the only part of the pump to come into contact with the fluid is the tubing. With the tubing or the head being easily replaced the pumps are relatively maintenance free. Liquids and viscous fluids are contained within the pump tube, which prevents contamination, and allows clean easy dispensing of almost any fluid including sterile agar and cell culture media A built in timer allows precise automatic dispensing of fixed volumes, with a manual mode for continuous operation. A foot operated switch allows hands free operation. The peristaltic pup is preferably powered by a simple 12 volt DC power supply. A removable bottle holder is preferably supplied which fits onto the rear of the unit.

Optionally, the dispensing system may include a piping system that connects some or all of the different elements of the dispensing system. This piping system may include any suitable type of piping or tubing, typically those made of flexible polymeric materials, for contacting and dispensing consumable beverages. Examples of suitable piping include food grade plastics, such as PTFE, PE, HDPE, PP, PVC, silicones, and the like. For example, TYGON® and NORPRENE® are two types of tubing that could be used.

Optionally, especially when the sterile beverage is viscous or semi-viscous, the dispensation system may also include a means for providing a diluent for the sterile beverage. This diluent may be any consumable liquid, including, but not limited to, water (hot, cold, or tepid, preferably hot), carbonated water (including seltzer or club soda), a milk or non-dairy milk-type product, a solution containing any of these, or any mixture thereof. It should be understood that when the diluent is susceptible to bacterial contamination, for example, when a milk product is used as a diluent, the dispensation system should include provision for inhibiting or preventing such contamination, e.g., such as sterile piping.

The term "pH" is used to designate the intensity or degree of acidity. The value of pH, the logarithm of the reciprocal of the hydrogen ion concentration in solution, is usually determined by measuring the difference potential between two electrodes immersed in a sample solution. Acid foods mean foods that have a natural pH of 4.6 or below.

Figure 1A:
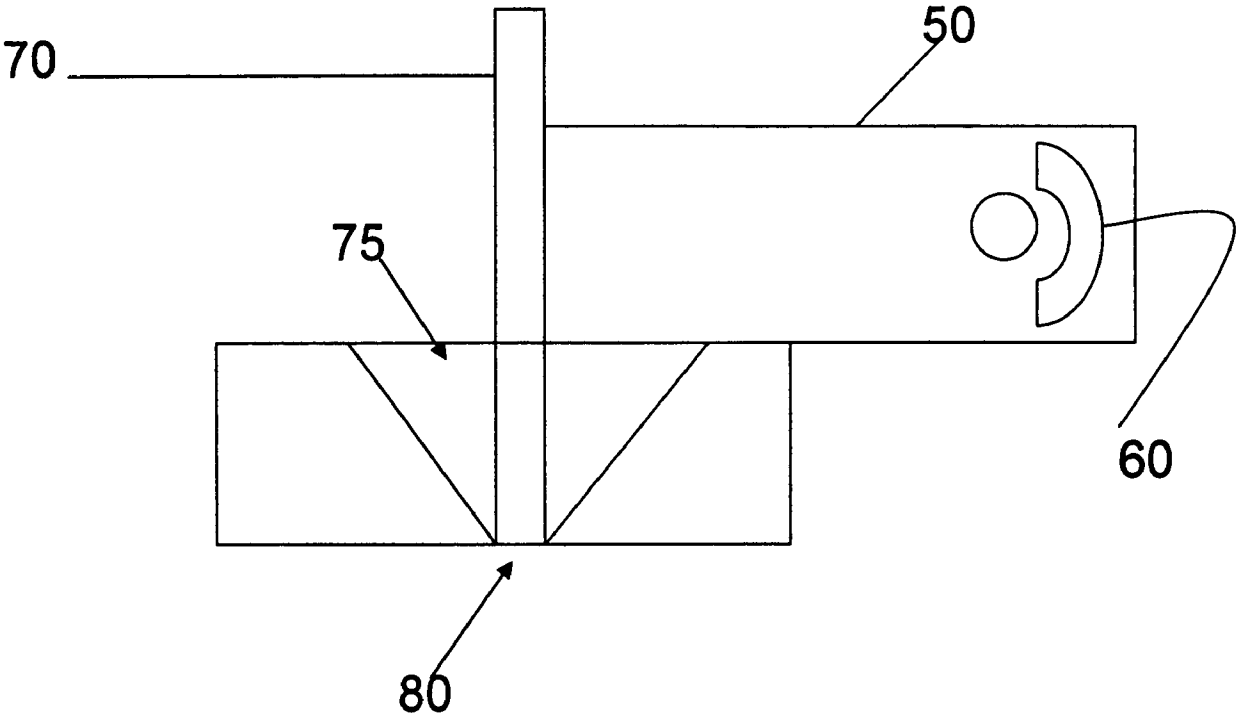
FIG. 1A is an isolated cross-sectional view of a dispenser portion of the apparatus.
Figure 1B:
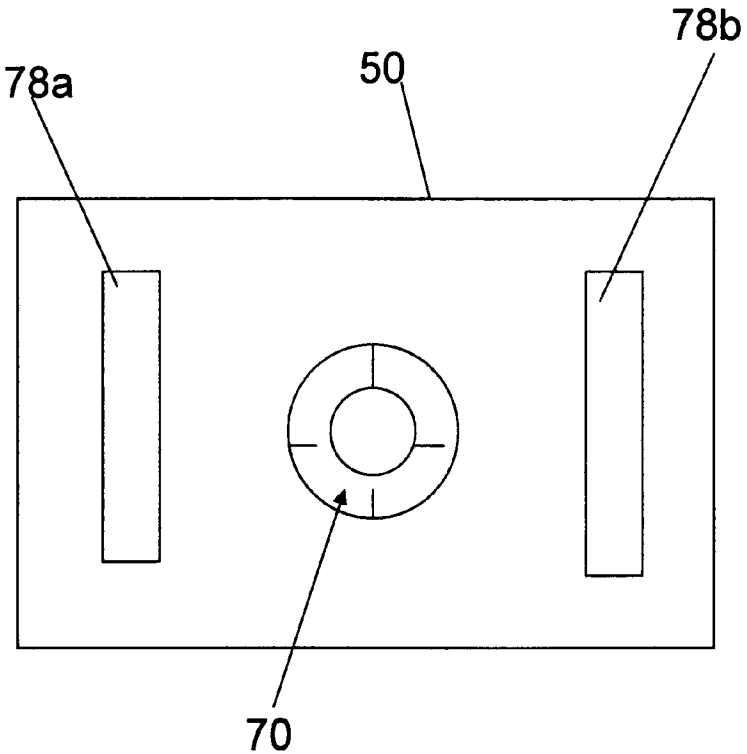
FIG. 1B is an isolated top plan view of a dispenser portion of the apparatus.

The source of sterile air 50 is preferably provided by an ultraviolet light 60 which sterilizes air, which then forced downward toward the dispenser 70, as shown in FIGS. 1A and 1B. Conventional ultraviolet lights for sterilization are known in the pertinent art. The sterile air is preferably flowed downward through a concentric chamber 75, which forces the sterile air about an outlet 80 of the dispenser 70. Alternatively, the temperature about the outlet 80 of the dispenser 70 is maintained at 75° C. or greater through use of a heating block system 78*a* and 78*b*, as shown in FIG. 1B. Yet, another alternative is to use a steam generator to heat and maintain the area about the outlet 80 of dispenser 70 to a temperature of 75° C. or greater. Further, a combination of UV light and heat may be utilized in practicing the invention. If cold milk is dispensed through the outlet 80, the outlet 80 will cool, requiring preferably a puff of steam to immediately bring the temperature of the outlet 80 above 75° C.

Figure 3:
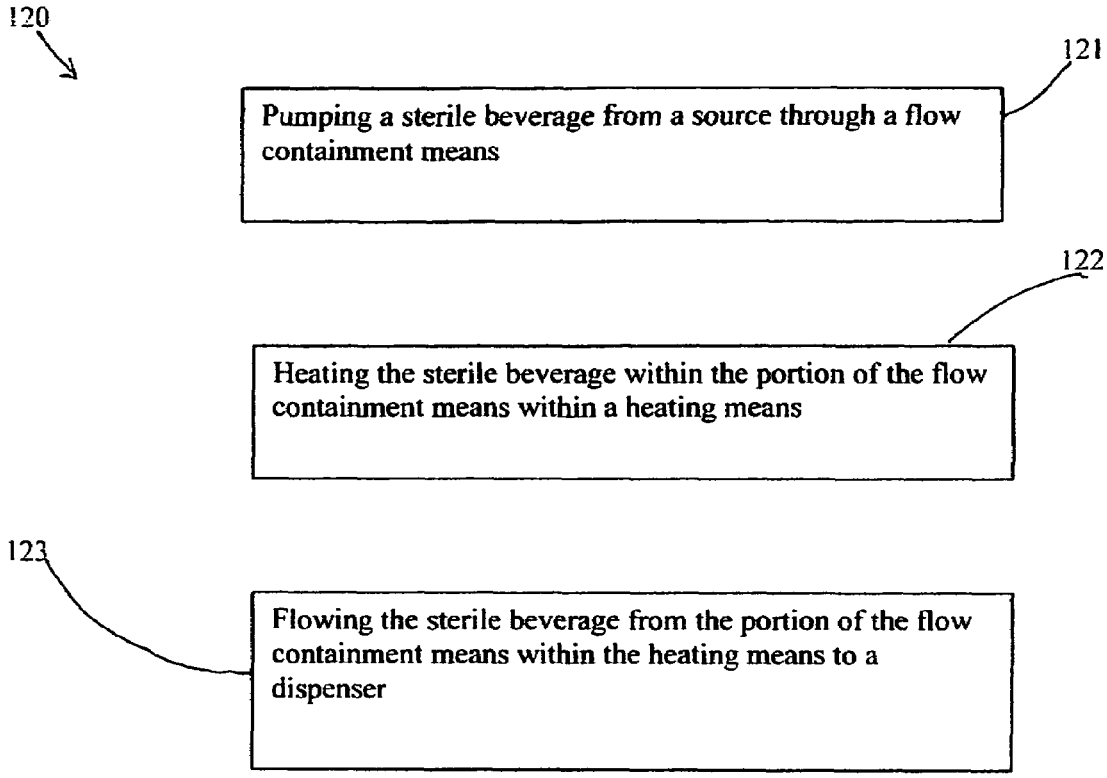
FIG. 3 is a flow chart of a general method of the present invention.

As shown in FIG. 3, a general method of the invention is designated 120. At block 121, a sterile beverage is pumped from a source through a flow containment means. At block 122, the sterile beverage is heated within a portion of the flow containment means within a heating means. At block 123, the heated sterile beverage is flowed from the heating means to a dispenser means.

Figure 4:
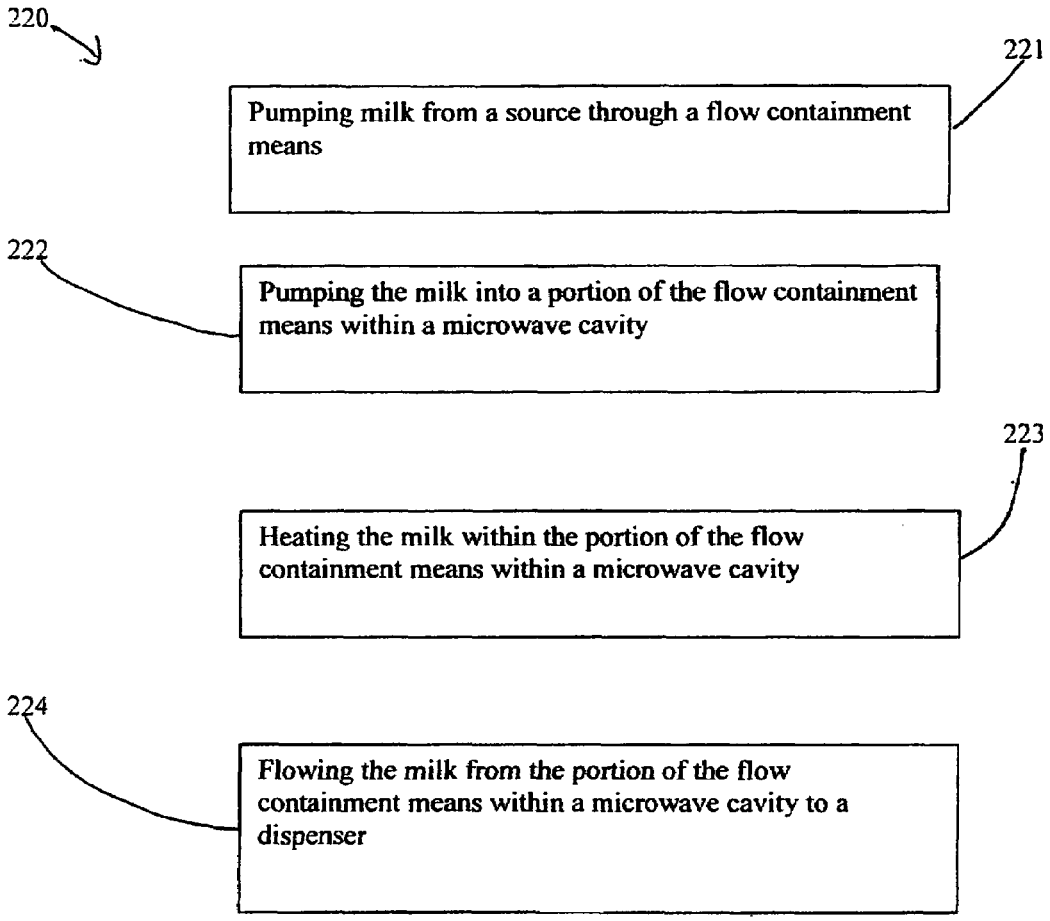
FIG. 4 is a flow chart of a method of the present invention.

As shown in FIG. 4, a method of the invention is designated 220. At block 221, milk is pumped from a source through a flow containment means. At block 22, the milk is pumped into a microwave cavity. The microwave cavity is the chamber within a microwave oven in which an article is placed for heating purposes. At block 223, the milk is heated within the flow containment means within the microwave cavity. At block 224, the milk within the flow containment means is flowed from the microwave cavity to a dispenser.

Figure 5:
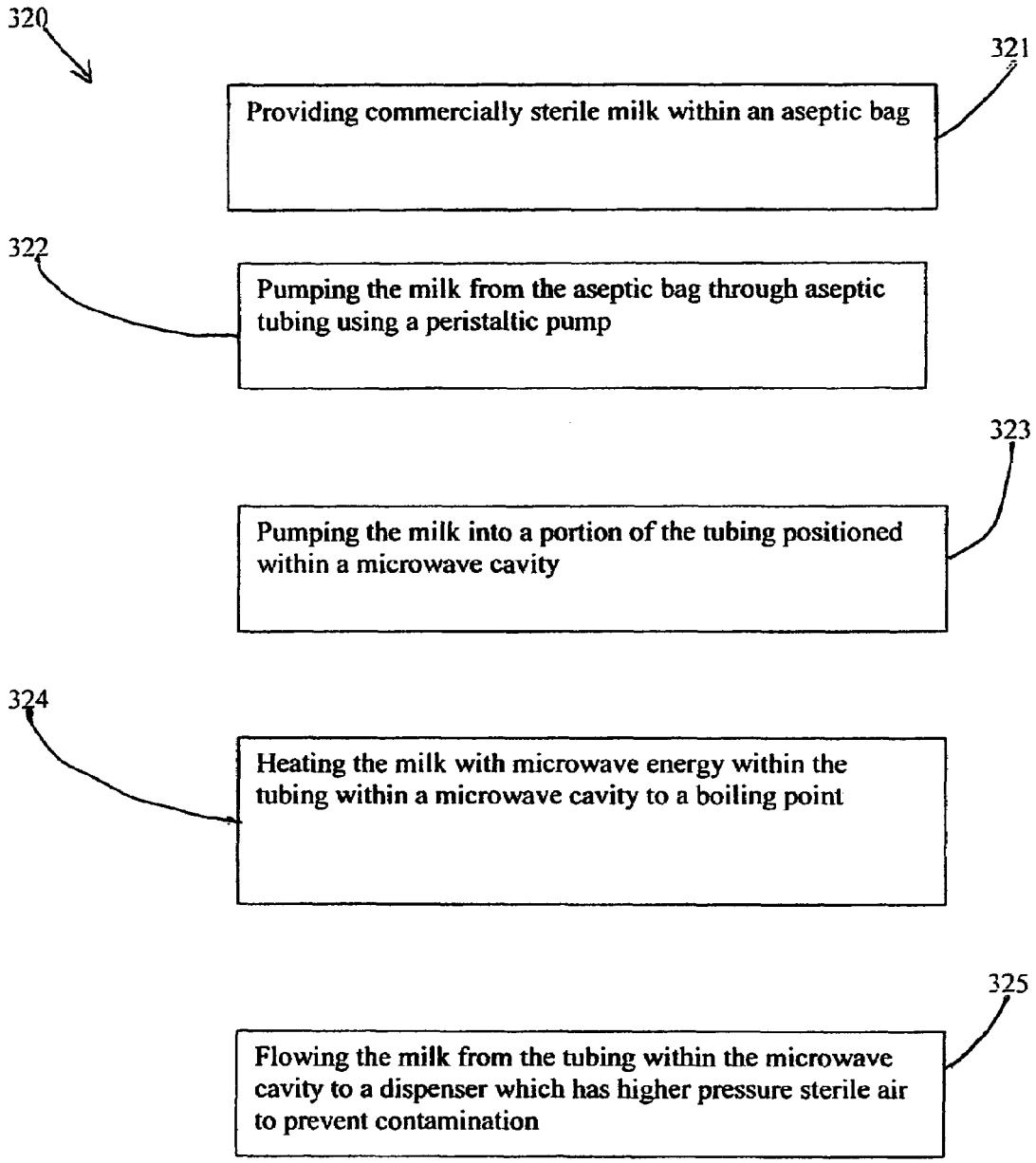
FIG. 5 is a flow chart of a specific method of the present invention.

As shown in FIG. 5, a specific method of the invention is designated 320. At block 321, commercially sterile milk is provided within an aseptic bag. At block 322, the milk is pumped from the bag through tubing using a peristaltic pump. At block 323, the milk is pumped into a portion of the tubing positioned within a microwave cavity. At block 324, the milk is heated with microwave energy to a point of boiling or near boiling within the tubing positioned within the microwave cavity. At block 325, the milk is flowed from the tubing within the microwave cavity to a dispenser which has higher pressure sterile air to prevent contamination of the tubing.

The following examples are for exemplary purposes and do not limit the scope or spirit of the present invention.

Example One

The peristaltic pump (600 ml/min) pumps for 20 seconds to fill the microwave cavity with 200 milliliters of aseptic milk at ambient temperature (25° C.). The milk is contained in a coil of plastic tubing and positioned in the cavity to maximize the absorption of microwave energy. The microwave is energized to deliver an initial absorbed energy sufficient to heat the milk from ambient to near boiling or the desired temperature. The peristaltic pump is energized for 20 seconds to replenish the cavity and flush the heated milk through the dispensing port.

Example Two

The peristaltic pump (600 ml/min) pumps for 20 seconds to fill the microwave cavity with 200 milliliters of aseptic milk at ambient temperature (25° C.). The milk is contained in a coil of plastic tubing and positioned in the cavity to maximize the absorption of microwave energy. The microwave is energized to deliver an initial absorbed energy sufficient to heat the milk from ambient to near boiling. The microwave continues to supply energy to the cavity until the vapor pressure of the water in the milk exceeded the ambient pressure pushing the boiling milk through the dispensing port. The microwave ceases operation when the milk is emptied from the chamber and the coil in the microwave cavity begins to cool. Sterile air supplied to the dispensing port is at a greater pressure and thus fills the tubing with sterile air preventing bacterial contamination with airborne bacteria

Example Three

The peristaltic pump (600 ml/min) pumps for 20 seconds to fill the microwave cavity with 200 milliliters of aseptic milk at ambient temperature (25° C.). The milk is contained in a coil of plastic tubing and positioned in the cavity to maximize the absorption of microwave energy. The microwave is energized to deliver an initial absorbed energy sufficient to heat the milk from ambient to near boiling. The microwave continues to supply energy to the cavity until the vapor pressure of the water in the milk exceeds the ambient pressure pushing the boiling milk through the dispensing port. As the boiling milk exits the dispensing port, additional sterile air or steam is added to the flow to incorporate bubbles or frothing the liquid.

Example Four

The peristaltic pump (600 ml/min) pumps for 20 seconds to fill the microwave cavity with 200 milliliters of aseptic milk at ambient temperature (25° C.) while the microwave was energized to deliver a continual absorbed energy sufficient to heat the milk from ambient to near boiling or the desired temperature. The peristaltic pump is de-energized. Alternatively, the microwave power can continue to supply power to the cavity to vaporize and flush the remaining milk through the dispensing port.

The data in Table One shows the amount of time required to heat product or water to boiling in an Emerson 1250 watt microwave model MW8779W.

TABLE ONE

| time | 50 ml water | 100 ml water | 150 ml water | 200 ml water |
|---|---|---|---|---|
| 0 | 18.1 | 18.7 | 17.9 | 18.4 |
| 15 | 55.7 | 33.9 | 30.3 | 27.9 |
| 30 | 78.4 | 50.3 | 43.4 | 38.4 |
| 45 | 94.2 | 67.9 | 56.4 | 47.9 |
| 60 | | 75.2 | 68.1 | 59.4 |
| 75 | | 89.4 | 83.1 | 68.1 |
| 90 | | 94.5 | 89.2 | 74.9 |
| 105 | | | 95 | Not measured |
| 120 | | | | 94.1 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention:

1. An apparatus for heating and aseptic dispensing of a sterile product, the apparatus comprising:

an aseptic bag of sterile milk;

a peristaltic pump;

a microwave oven for heating the aseptic bag of sterile milk;

a dispenser having a source of sterile air maintained at a higher pressure to prevent contamination; and a tubing connected between the aseptic bag and the peristaltic pump, the peristaltic pump and the microwave oven, and the microwave oven and the dispenser.

2. The apparatus according to claim 1 wherein the apparatus further comprises an ultraviolet light and a source of air for providing the source of sterile air, the sterile air flowing around the dispenser.

3. The apparatus according to claim 1 wherein the apparatus further comprises a heating block to generate a temperature greater than 75° C. about an outlet of the dispenser.

4. The apparatus according to claim 1 wherein the apparatus further comprises a steam generator to generate a temperature greater than 75° C. about an outlet of the dispenser.

5. An apparatus for heating and aseptic dispensing of a sterile product, the apparatus comprising:

an aseptic bag of sterile milk;

a peristaltic pump;

a microwave oven for heating the aseptic bag of sterile milk;

a dispenser; and a tubing connected between the aseptic bag and the peristaltic pump, the peristaltic pump and the microwave oven, and the microwave oven and the dispenser wherein a portion of the tubing is positioned within a cavity of the microwave oven.

* * * * *